US006305191B1

(12) United States Patent
Higginbotham

(10) Patent No.: US 6,305,191 B1
(45) Date of Patent: Oct. 23, 2001

(54) SEPARATION OF AIR

(75) Inventor: Paul Higginbotham, Guildford (GB)

(73) Assignee: The BOC Group plc, Windlesham (GB)

( * ) Notice: Subject to any disclaimer, the term of this patent is extended or adjusted under 35 U.S.C. 154(b) by 0 days.

(21) Appl. No.: 09/566,274

(22) Filed: May 5, 2000

(30) Foreign Application Priority Data

May 7, 1999 (GB) ..... 9910701

(51) Int. Cl.[7] ..... F25J 3/04
(52) U.S. Cl. ..... 62/646
(58) Field of Search ..... 62/646, 647, 643

(56) References Cited

U.S. PATENT DOCUMENTS 2,520,862 8/1950 Swearingen .
5,586,451 12/1996 Koeberle et al. .
5,934,105 8/1999 Patrick .

*Primary Examiner*—William Doerrler
*Assistant Examiner*—Malik N. Drake
(74) *Attorney, Agent, or Firm*—Wan Yee Cheung; Salvatore P. Pace

(57) ABSTRACT

A first stream of air is compressed in a main air compressor and a booster compressor is cooled at a first pressure by passage through a main heat exchanger. The cooled stream is introduced without further compression into the higher pressure column of a double rectification column including in addition to the column a lower pressure column and a condenser-reboiler. A second stream of compressed air is expanded from a second pressure in an expansion turbine with the performance of external work. The expanded second stream of air is introduced into the lower pressure column. An oxygen product, typically impure, is taken from the bottom region of the lower pressure column. The second pressure is less than the first pressure column. The second pressure is less than the first pressure, the second air stream being taken from intermediate the compressors.

13 Claims, 5 Drawing Sheets

SEPARATION OF AIR

BACKGROUND OF THE INVENTION

This invention relates to a method of and plant for the separation of air.

The separation of air by rectification is very well known indeed. Rectification is a method in which mass exchange is effected between a descending stream of liquid and an ascending stream of vapor such that the ascending stream of vapor is enriched in a more volatile component (nitrogen) of the mixture to be separated and the descending stream of liquid is enriched in a less volatile component (oxygen) of the mixture to be separated.

It is known to separate air in a double rectification column comprising a higher pressure column which receives a first stream of purified, compressed, vaporous air at a temperature suitable for its separation by rectification, and a lower pressure column which receives a stream of oxygen-enriched liquid air for separation from the higher pressure rectification column, and which is in heat exchange relationship with the higher pressure rectification column through a condenser-reboiler, of which the condenser provides liquid nitrogen reflux for the separation and the reboiler provides an upward flow of vapor in the lower pressure column.

A double rectification column may be operated so as to produce a liquid oxygen fraction at the bottom of the lower pressure column and a vaporous nitrogen fraction at the top of the lower pressure column. The oxygen fraction may be essentially pure, containing less than 0.5 per cent by volume of impurities, or may be impure containing up to 50 per cent by volume of impurities.

There is a net requirement for refrigeration to be provided to the air separation plant. At least part of this requirement arises from the operation of the double rectification column at cryogenic temperatures. Particularly if none of the products of the air separation is taken in liquid state, the requirements for refrigeration are typically met by raising the pressure of a second stream of compressed air to at least two bar above the operating pressure at the top of the higher pressure column and expanding it with the performance of external work in an expansion turbine which exhausts into the lower pressure column. Typically, the turbine is coupled to a booster-compressor which raises the pressure of the air to above that at the top of the higher pressure column.

U.S. Pat. No. 5,237,822 discloses an air separation process employing two extension expansion turbines, one exhausting into the lower pressure column, and the other exhausting into the higher pressure column. The former turbine has the same inlet pressure as the higher pressure column.

U.S. Pat. No. 5,511,381 discloses a similar air separation process, but with both turbines having inlet pressures higher than the inlet pressure of the higher pressure column.

In both of the above patents the air separation process includes forming a third compressed air stream at a higher pressure than the other air streams. The third compressed air stream is employed to vaporise an oxygen product stream, it expanded and is introduced into the double rectification column in liquid state.

U.S. Pat. No. 5,586,451 discloses with reference to FIG. 2 a process in which a single air stream is substituted for the aforementioned first and third air streams. The single air stream is compressed to a higher pressure than the second air stream, is expanded, and is introduced into the higher pressure column in partially condensed state. Most of the air, therefore, has to be compressed to a pressure substantially above the operating pressure of the higher pressure column.

U.S. Pat. No. 5,537,570 provides examples of a further kind of air separation plant. There is a first condenser-reboiler which condenses a part of the top nitrogen fractions separated in the higher pressure column. The condensation is effected by indirect heat exchange with a stream of the bottom oxygen-enriched liquid fraction formed in the higher pressure column. As a result, the stream of the bottom oxygen-enriched liquid fraction is partially reboiled. Resulting vapor and residual liquid are fed to the lower pressure column. The plant employs a single generator-loaded expansion turbine exhausting into the lower pressure column. The air to be separated is compressed in a main, plural stage, compressor. The main air feed to the higher pressure rectification column is taken from a lower pressure stage than the feed to the expansion turbine.

An air separation plant typically consumes a considerable amount of power. It is therefore desirable for the air separation plant to have a configuration which enables power consumption to be minimised without unduly increasing its capital cost. In order to minimise the power consumption much attention in the art has been recently focused upon operating the lower pressure column with two reboilers, one operating at a higher temperature and being heated by a flow of the air to be separated, and the other operating at a lower temperature and being heated by a flow of nitrogen separated in the higher pressure column. A disadvantage of such a plant is that the requirement for a second reboiler adds to its complexity and capital cost.

SUMMARY OF THE INVENTION

It is an aim of the present invention to provide a method and plant for separating air by rectification which are able to be operated at a favourable net power consumption without imposing on the plant an unacceptably high capital cost and without the need to have two reboilers associated with the lower pressure rectification column.

According to the present invention there is provided a method of separating air by rectification including cooling a first stream of compressed air, at a first pressure, in a main heat exchanger to a temperature suitable for its separation by rectification, introducing the cooled first stream without further compression into the higher pressure column of a double rectification column including, in addition to the higher pressure column, a lower pressure column, in which a bottom liquid oxygen fraction is formed and a condenser-reboiler placing the higher pressure column in indirect heat exchange relationship with the lower pressure column, expanding with the performance of external work a second stream of compressed air from a second pressure, introducing the expanded second stream of air into the lower pressure column, and taking an oxygen product from the bottom region of the lower pressure column, wherein the second pressure is less than the first pressure and the cooled first stream is introduced into the higher pressure column at essentially the first pressure.

The invention also provides a plant for separating air by rectification, including at least two compression stages in series for compressing a flow of air, a main heat exchanger having first passage(s) for the cooling at a first pressure of a first stream of the compressed air to a temperature suitable for its rectification, the first passage(s) communicating with a first chosen one of the compression stages, whereby the first pressure is essentially the outlet pressure of the first chosen compression stage, and second passage(s) for the cooling at a second pressure of a second stream of the compressed air to a temperature above that suitable for its rectification, the second passage(s) communicating with a second chosen one of the compression stages whereby the second pressure is essentially the outlet pressure of the second chosen compression stage, a double rectification column including a higher pressure column, a lower pressure column and a condenser-reboiler placing the higher pressure column in indirect heat exchange relationship with the lower pressure column, the higher pressure column being arranged to operate under a pressure at its bottom not greater than the therein bottom liquid oxygen fraction; an inlet to the higher pressure column communicating with the first passage(s); an expansion turbine for expanding with the performance of external work the second stream of the compressed air, the expansion turbine being arranged to operate at an inlet pressure not greater than the second pressure; an inlet to the lower pressure column communicating with the expansion turbine, and an outlet from a bottom region of the lower pressure column for an oxygen product, wherein the first chosen compression stage is downstream of the second chosen compression stage, whereby the second pressure is less than the first pressure. There is no expansion means intermediate the first passages and the higher pressure column.

The term "essentially the same pressure" is used herein to indicate that one given pressure is within plus or minus 0.5 bar of another given pressure.

The method and plant according to the invention offer a number of advantages. By operating the expansion turbine at a lower inlet pressure than the higher pressure column the amount of power consumed in compressing the air to be separated can be kept relatively low. The extent of this advantage generally increases with the proportion of the air to be separated which can effectively be sent to the expansion turbine. This in turn depends on the purity of the oxygen product and the proportion of the products of the separation which can be produced as liquid, as will be discussed below. As well as power saving, other advantages can be achieved when a particularly large proportion of the air to be separated is expanded with the performance of external work and introduced into the lower pressure column. In particular, it is possible to operate the lower pressure column relatively efficiently and with a relatively small vapor traffic below the level at which the expanded air is introduced. In addition, the thermal load on the condenser-reboiler is reduced. The effective diameter of the lower pressure column may be reduced in the lower part of the lower pressure column thereby making possible a reduction in the total area of liquid-vapor contact surfaces. Similarly, the effective diameter of the higher pressure column may be reduced. The size of the condenser-reboiler may also be reduced. Second, there is no need for a conventional booster-compressor to be associated with the expansion turbine. Instead, an electrical generator may be coupled to the expansion turbine. As a result, a significant amount of electrical power may be exported, thereby reducing the net power consumption of the method and plant according to the invention. Third, acceptably efficient operation of the plant according to the invention may be maintained even over a relatively wide range of operating conditions. This facilitates an approach to the manufacture of air separation plants in which use of standard or prefabricated units is made.

Typically, the oxygen product is withdrawn from the lower pressure rectification column in liquid state, is pressurized, and is vaporized in indirect heat exchange with a third flow of the compressed air which is at a third pressure higher than the first pressure. (This heat exchange may be performed in the main heat exchanger or in a separate one.)

Preferably at least 30 mole per cent of the oxygen product is impure, that is it has an oxygen content in the range of 50 to 98.5 mole per cent. Generally, the production of impure oxygen can be accompanied with relatively high flow rates of air through the expansion turbine.

The method and plant according to the invention are particularly suited to producing an oxygen product having an oxygen content in the range of 50 to 98.5 mole per cent, preferably in the range of 50 to 97 mole per cent, and more preferably in the range of 85 to 97 mole per cent. In these more preferred examples, when the oxygen product is pressurized and vaporized as aforesaid, preferably at least 22 per cent by volume of the flow of air to be separated forms the expanded second air stream, more preferably from 23 per cent to 30 per cent by volume thereof. In such examples, the first stream of compressed air typically constitutes less than 50 per cent by volume of the total of the air to be separated.

Alternatively, the oxygen product may be withdrawn from the lower pressure rectification column in vapor state, and, if desired, compressed to a desired delivery pressure downstream of being warmed to a non-cryogenic temperature in the main heat exchanger. In this case, there is no need to condense a third stream of the compressed air. As a result, it becomes possible to form the second stream of compressed air as an even greater proportion of the total flow of air to be separated. For example, if the oxygen product contains from 70 to 97 mole per cent of oxygen, typically at least 30 per cent of the total flow of air to be separated may form the second stream of compressed air.

The method and plant according to the invention are also well suited to the simultaneous production of impure and pure oxygen products. The impure oxygen product may contain from 50 to 98.5 mole per cent, preferably 50 to 97 mole per cent, and more preferably 70 to 97 mole per cent of oxygen, and the pure oxygen product contains more than 97.5 mole per cent, preferably more than 99.5 mole per cent of oxygen. Preferably up to about 70% of the total oxygen product is taken at the higher purity. This can be accomplished without a substantial reduction in the flow of the second stream of compressed air to the expansion turbine. The proportion of the total oxygen product that can be taken at the higher purity is generally greater than in comparable dual reboiler air separation methods and plants. The pure oxygen product is taken from the bottom region and the impure oxygen product from an intermediate region of the lower pressure column. Preferably, both oxygen products are taken in liquid state, are pressurized and are vaporized in indirect heat exchange with a third flow of the compressed air which is at a third pressure higher than the first pressure.

Preferably, the expansion turbine has a ratio of inlet pressure to outlet pressure in the range of 1.2:1 to 3.8:1, and more preferably 1.4:1 to 2.5:1.

The higher pressure column is desirably arranged to operate such that the pressure at its bottom is essentially the same as the first pressure. Thus, preferably, no expansion device is located intermediate the inlet to the higher pressure column for the first stream of the compressed air and the outlet from the main heat exchanger for this stream of the compressed air.

The said at least two compression stages in series may if desired form separate stages of a main air compressor. Alternatively, one or more upstream stages may form the main air compressor and one or more downstream compression stages may be provided by one or more booster-compressors. Accordingly the main air compressor can be operated at a pressure lower than the operating pressure of the higher pressure column. Preferably, there are at least two compression stages downstream of the second chosen compression stage. Further, there is preferably a purification unit located intermediate the second compression stage and the downstream compression stages, the purification unit being operable to remove impurities, particularly carbon dioxide and water vapor, which would otherwise have a deleterious effect on the operation of the plant.

Although it is preferred that the expansion turbine be generator-loaded, it can alternatively be employed in driving a booster-compressor employed to raise the pressure of the said third stream of air or another process stream. It can also be loaded with a brake to dissipate the expansion energy.

The method according to the present invention is particularly suited to the separation of air when no liquid products of the separation are taken or when the total production of such liquid products is less than ten per cent, preferably less than five per cent, more preferably less than two per cent of the total production of the oxygen product. In general, production of liquid products requires a higher inlet pressure to the expansion turbine than when no liquid products are produced, and is therefore not preferred.

The higher pressure column and the lower pressure column may both be constituted by one or more vessels in which liquid and vapor phases are countercurrently compacted to effect separation of the air, as, for example, by contacting the vapor and liquid phases on packing elements or on a series of vertically spaced trays or plates mounted within the vessel or vessels.

BRIEF DESCRIPTION OF THE DRAWINGS

The method and plant according to the invention will now be described by way of example with reference to the accompanying drawings.

Like parts in the drawings are indicated by the same reference numeral.

DETAILED DESCRIPTION OF THE INVENTION

Figure 1:
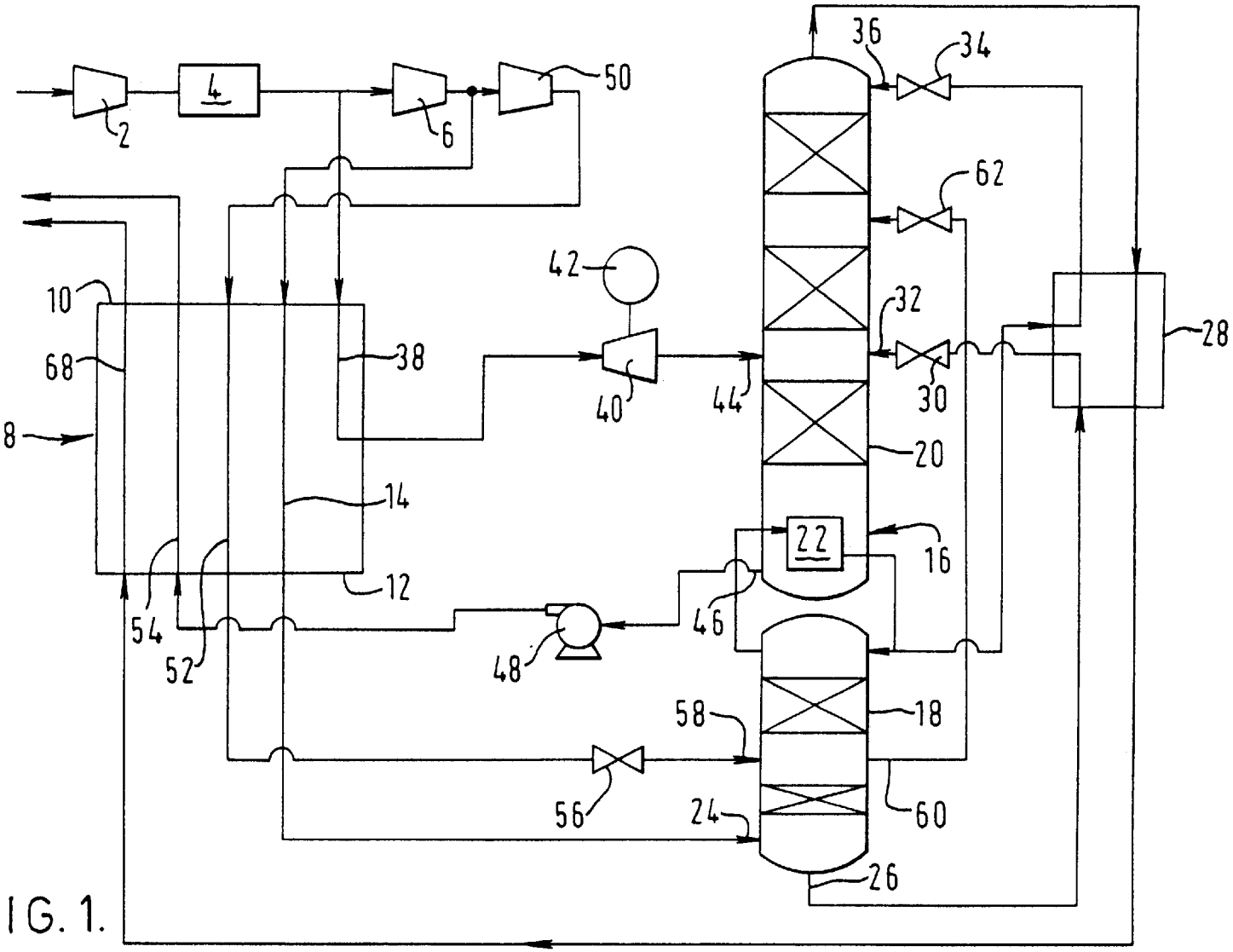
FIG. 1 is a schematic flow diagram of one embodiment of an air separation plant according to the present invention.

Referring to FIG. 1, a flow of air is compressed in a main air compressor 2. Heat of compression is extracted from the resulting compressed air in an after-cooler (not shown) associated with the main air compressor 2. The main air compressor 2 typically comprises a plurality of compression stages. The compressed air flow is purified in an adsorption unit 4. The purification comprises removal from the air flow of relatively high boiling point impurities, particularly water vapor and carbon dioxide, which would otherwise freeze in the low temperature parts of the apparatus. Other impurities such as unsaturated hydrocarbons are also removed. The unit 4 may effect the purification by pressure swing adsorption or temperature swing adsorption. The unit 4 may additionally include one or more layers of catalyst for the removal of carbon monoxide and hydrogen impurities. Such removal of carbon monoxide and hydrogen impurities is described in U.S. Pat. No. 5,110,569. The construction and operation of adsorptive purification units are well known and need not be described further herein.

A part of the purified air flow is further compressed in a first booster-compressor 6. The resulting further compressed air flow is cooled in an after-cooler (not shown) to remove heat of compression. A first stream of compressed air is taken from this cooled further compressed flow of air and passes directly (without any further compression and without any expansion) to a main heat exchanger 8. The first stream of compressed air passes through a first set of passages schematically represented by the line 14 in FIG. 1 from the warm end 10 to the cold end 12 of the main heat exchanger 8. The first stream of compressed air is thus cooled to a temperature suitable for its rectification by indirect heat exchange with returning streams. The resulting cooled first stream of compressed air is introduced through an inlet 24 into a bottom region of a higher pressure rectification column 18. There is no compression or expansion of the cooled first air stream intermediate the cold end 12 of the main heat exchanger and the inlet 24. Accordingly, the pressure at the bottom of the higher pressure column 18 is essentially the pressure at which the first stream of compressed air leaves the main heat exchanger 8 (which in turn is essentially the outlet pressure of the compressor 6) and this pressure is referred to herein as the first pressure.

The higher pressure column 18 forms one column of a double rectification column 16. The double rectification column 16 also includes a lower pressure column 20 and a condenser-reboiler 22 which places the top region of the higher pressure column 18 in indirect heat exchange relationship with the bottom region of the lower pressure column 20.

In operation, the air is separated in the higher pressure column 18 into a bottom oxygen-enriched liquid fraction and a top nitrogen vapor fraction. A stream of the oxygen-enriched liquid fraction is withdrawn from the bottom of the higher pressure column 18 through an outlet 26. The oxygen-enriched liquid air stream is sub-cooled in a further heat exchanger 28, is passed through a Joule-Thomson or throttling valve 30 and is introduced into a chosen intermediate region of the lower pressure column 20 through an inlet 32.

Nitrogen vapor flows from the top of the higher pressure column 18 into the condenser-reboiler 22 and is condensed therein by indirect heat exchange with a boiling impure liquid oxygen fraction at the bottom of the lower pressure column 20. A part of the resulting liquid nitrogen condensate is returned to the higher pressure column 18 as reflux. The remainder of the condensate is sub-cooled by passage through the heat exchanger 28, is passed through a throttling or Joule-Thomson valve 34 and is introduced into the lower pressure column 20 as reflux through an inlet 36.

The oxygen-enriched liquid air withdrawn from the higher pressure column 18 through the outlet 26 forms one source of the air that is separated in the lower pressure column. Another source of this air is a second stream of compressed air which is that part of the purified air which downstream of the purification unit does not flow through the booster-compressor 6. The second stream of compressed air is cooled in the main heat exchanger 8 by passage through a second set of passages shown schematically in FIG. 1 by the line 38. The second set of passages extends from the warm end 10 of the main heat exchanger 8 to an intermediate region thereof. The thus cooled second stream of compressed air leaves the main heat exchanger 8 at a temperature above that at which it is to be separated in the double rectification column 16 and at a second pressure which is less than the first pressure. The second pressure is essentially the same as the outlet pressure of the main compressor 2. The resulting cooled second stream of compressed air flows into an expansion turbine 40 (without any further compression or any expansion intermediate its exit from the main heat exchanger 8 and the expansion turbine 40). It is expanded in the expansion turbine 40 to essentially the operating pressure and temperature of the previously mentioned intermediate region of the lower pressure column 20. The thus expanded second stream of air is introduced into that intermediate region through an inlet 44. The expansion in the turbine 40 takes place with the performance of external work. As schematically shown in FIG. 1, the expansion turbine 40 is coupled to a generator 42 with the result that electrical power is generated. The expansion turbine 40 is the only expansion turbine employed in the plant shown in FIG. 1.

The flows of air are separated in the lower pressure column 20 into a top nitrogen vapor fraction and a bottom impure liquid oxygen fraction having an oxygen content in the range of 50 to 98.5 mole per cent, preferably in the range of 70 to 98.5 mole per cent, and more preferably in the range of 70 to 97 mole per cent. The condenser-reboiler 22 is effective to reboil the bottom impure liquid oxygen fraction by indirect heat exchange with the condensing nitrogen. The resulting oxygen vapor ascends the lower pressure column 20 and is contacted therein with downflowing liquid. Not all the bottom impure liquid oxygen fraction is reboiled. A part of this fraction is withdrawn as product from a bottom outlet 46 by a pump 48 which raises the impure oxygen to a delivery pressure. Vaporization of the oxygen product is effected in the main heat exchanger 8. To this end, a third stream of compressed air at a third pressure higher than the first pressure is employed. The third stream of compressed air is formed of that air which, downstream of the after-cooler associated with the first booster-compressor 6, is not passed through the first passages 14 of the main heat exchanger 8 as the first stream of compressed air. The third stream of compressed air is raised to a desired pressure in a second booster-compressor 50 and has heat of compression removed from it in an after-cooler (not shown). The thus cooled third stream of compressed air flows through a third set of passages 52 extending from the warm end 10 to the cold end 12 of the main heat exchanger 8. The pressure at which the third stream of compressed air leaves the main heat exchanger 8 at its cold end 12 and hence the outlet pressure of the second booster-compressor 50 are selected having regard to the outlet pressure of the pump 48 so as to keep down thermodynamic inefficiencies in the operation of the heat exchanger 8, particularly in the region thereof extending from the cold end 12 to the location where the impure liquid oxygen has vaporized. The pressurized impure liquid oxygen stream passes through the main heat exchanger along a fourth set of passages 54 from its cold end 12 to its warm end 10. The resulting warmed oxygen product may be supplied at approximately ambient temperature to an end user of it.

The third stream of compressed air, downstream of its passage through the main exchanger 8, is also separated in the double rectification column 16. The cooled third stream of compressed air passes from the cold end 12 of the main heat exchanger 8 through a further Joule-Thomson or throttling valve 56 and enters the higher pressure column 18 at an intermediate level thereof through an inlet 58. Thus, additional reflux is provided for the bottom of the higher pressure column 18. A stream of liquid is, however, withdrawn through an outlet 60 from the same intermediate level of the higher pressure column 18. It is passed through yet another Joule-Thomson or throttling valve 62 and is introduced into the lower pressure column 20 through an inlet 64 at a further intermediate level thereof located above the level of the inlets 32 and 44. This liquid air therefore provides further reflux for the section of the lower pressure column 20 extending upwardly from the inlet 32 to the inlet 64.

A nitrogen stream is also withdrawn as product (or waste) from the top of the lower pressure column 20. The stream passes first through the heat exchanger 28, thereby providing the necessary cooling for this heat exchanger 28 and secondly through a fifth set of passages 68 extending from the cold end 12 to the warm end 10 of the main heat exchanger 8.

In typical operation of the plant shown in FIG. 1, the first pressure at which the first stream of compressed air enters the higher pressure column 18 through the inlet 24 is typically in the range of 3.5 to 5 bar. The lower pressure column 20 typically has an operating pressure at its top in the range of 1.2 to 1.4 bar absolute. It can thus be appreciated that taking the second stream of compressed air for expansion in the turbine 40 of the performance of external work does not in any way raise the operating pressure of the higher pressure column 18 or the lower pressure column 20. Typically, the second pressure is in the range of 1.8 to 3.5 bar. As a result, the main air compressor may typically require only two compression stages (with an intercooler (not shown) located therebetween), thus simplifying it in comparison with conventional air separation plant that typically use main air compressors having three or four compression stages. Further, because the second stream of compressed air need be compressed only to a relatively low pressure in comparison with the first stream of compressed air, and because the second stream of compressed air is preferably more than twenty per cent of the total flow of air into the plant, the power consumption of the plant is relatively low in comparison with comparable known single reboiler air separation plants.

Figure 2:
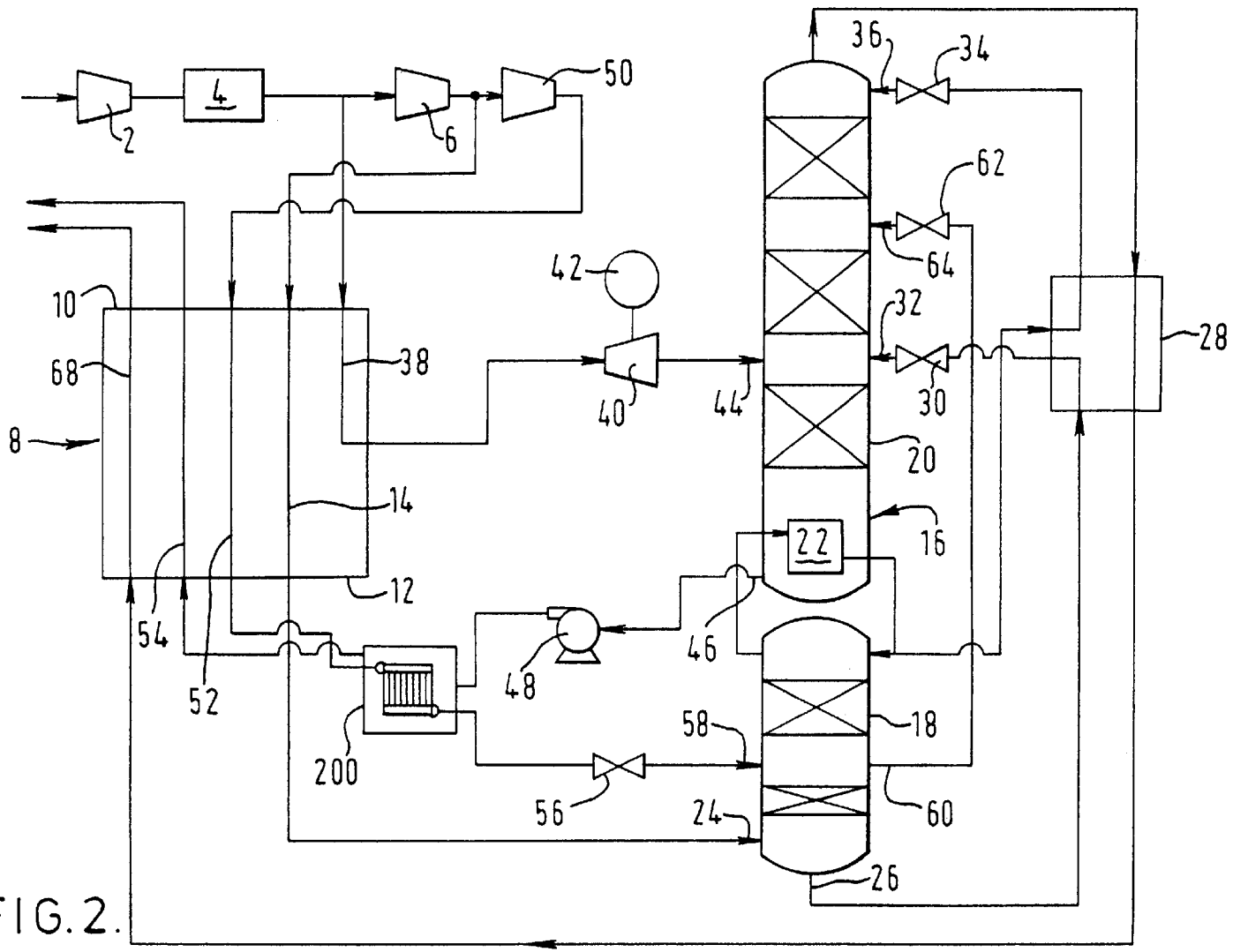
FIG. 2 is a schematic flow diagram of an additional air separation embodiment of a separation plant according to the present invention.

Various changes and modifications can be made to the plant shown in FIG. 1. For example, referring now to FIG. 2, there can be included an oxygen vaporiser 200 intermediate the pump 48 and the cold end 12 of the main heat exchanger 8. Now, the pressurized stream of impure liquid oxygen is vaporized in the vaporiser 200 in indirect heat exchange with the third stream of compressed air. Such a plant is particularly suitable for use when the pressure of the oxygen product is below 5 bar absolute.

Figure 3:
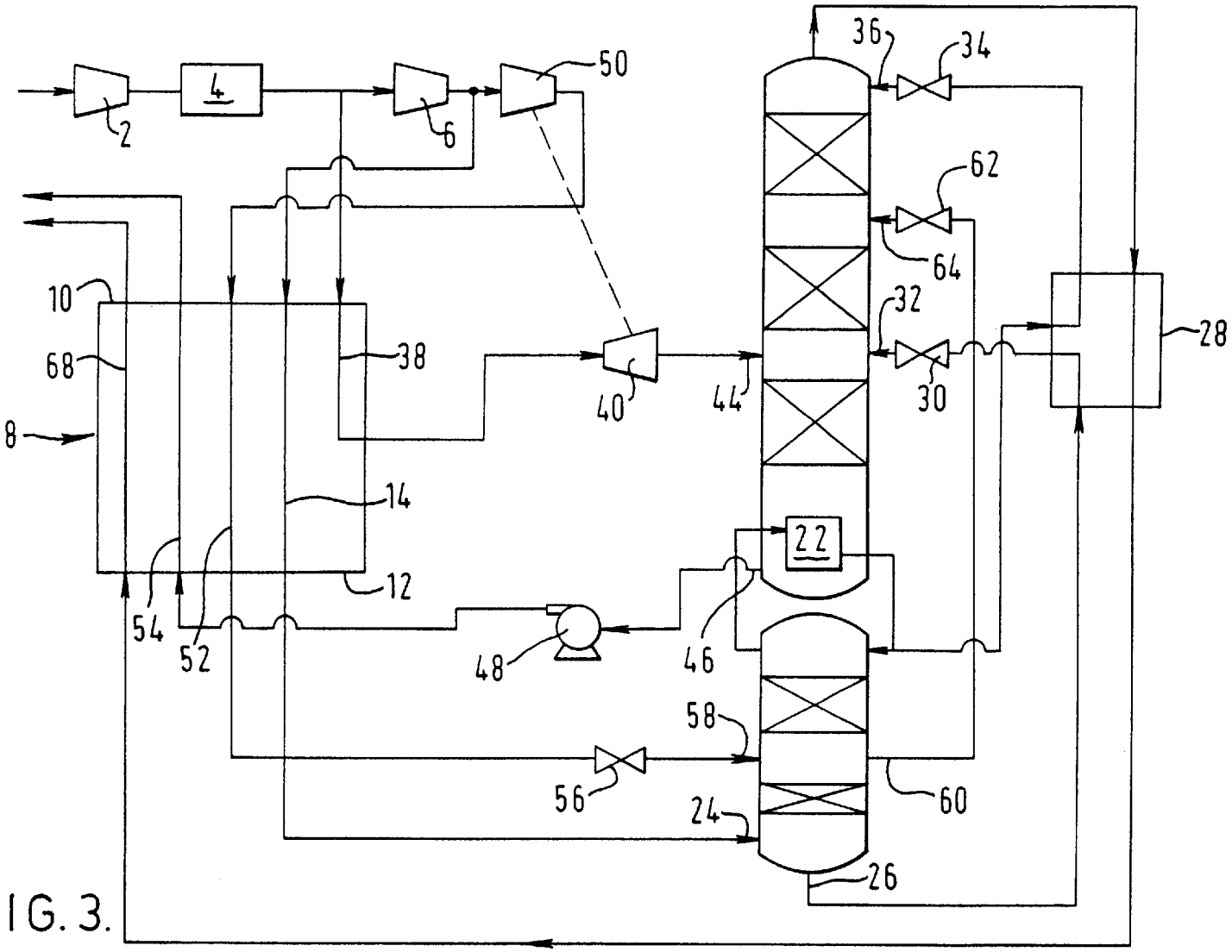
FIG. 3 is a schematic diagram of a third embodiment of an air separation plant according to the present invention.

Referring now to FIG. 3, there is shown a modification to the plant illustrated in FIG. 1. In this modification the generator 42 is omitted and the expansion turbine is instead coupled to the second booster-compressor. Thus, the work of expansion of the second stream of compressed air is used in compressing the third air stream in the compressor 50. In some examples, the work of expansion is not sufficient to meet all the requirements of work of compression in the compressor 50. In such examples the booster-compressor 50 can also be coupled to an electric motor (not shown).

Figure 4:
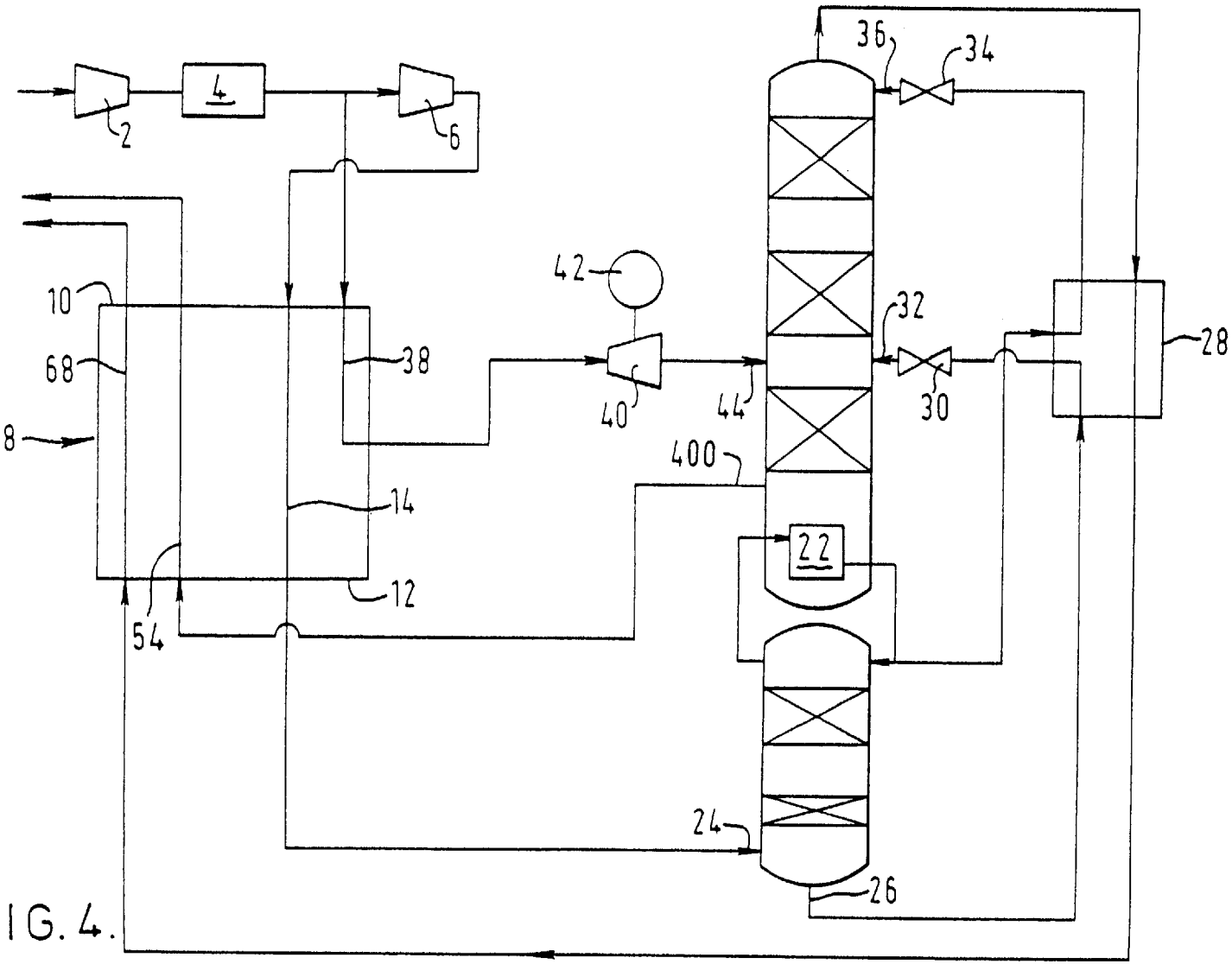
FIG. 4 is a schematic diagram of a fourth embodiment of an air separation according to the present invention.

Referring now to FIG. 4, there is shown yet another modification to the plant illustrated in FIG. 1. In this modification, the impure oxygen product is taken in vapor state from the lower pressure column 20. Thus, the fourth set of passages 54 in the main heat exchanger 8 communicate directly with an outlet 400 from the lower pressure column 20. The outlet 46, the pump 48 and associated pipework are therefore omitted. In addition, the booster-compressor 50 and the third set of passages 52 through the main heat exchanger 8 and associated pipework are also omitted. The second air stream thus forms the entire flow through to the first booster compressor 6. The outlet 60, valve 62 and associated pipework are also omitted.

Figure 5:
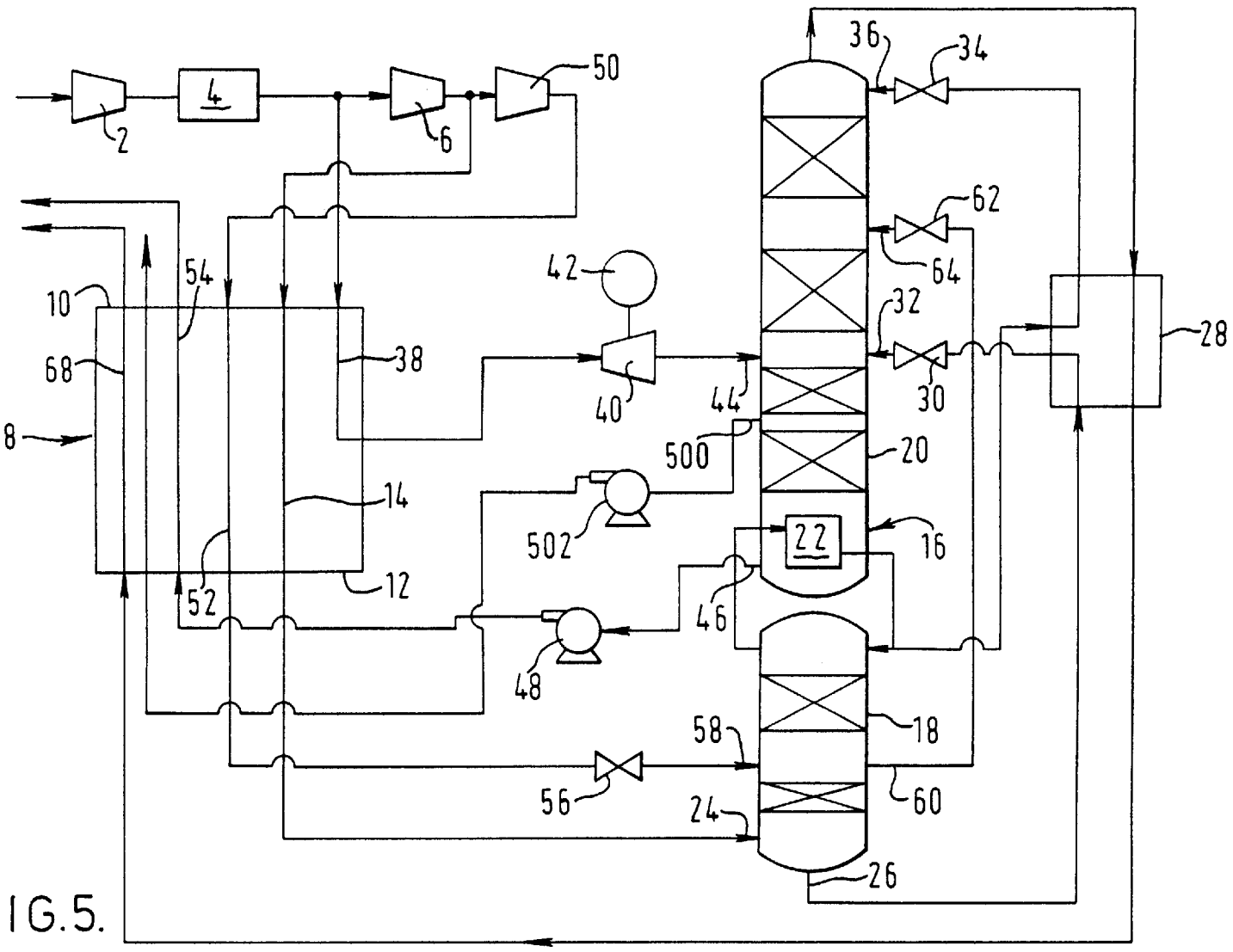
FIG. 5 is a schematic diagram of a fifth embodiment of an air separation plant according to the present invention.

Referring now to FIG. 5, there is shown a yet further modification to the plant illustrated in FIG. 1. Now the lower pressure column 20 is provided with additional separation stages to enable a relatively pure oxygen product containing less than 2.5 mole per cent and typically less than 0.5 mole per cent of impurities to be taken by the pump 48. An impure oxygen product, preferably containing from 70 to 96 mole per cent of oxygen is also taken. To this end the lower pressure column 20 is provided with a second outlet 500 at an intermediate level thereof for the impure oxygen product. The impure oxygen product is typically withdrawn in liquid state through the outlet 500 by means of a pump 502 which raises the impure product to a chosen pressure. The pressurized impure liquid oxygen is vaporized by passage through the main heat exchanger from its cold end 12 to its warm end 10.

Other modifications and variations can be made. For example, it is possible to take a small amount, typically up to 10 per cent of the total oxygen product of the plant shown in any of the drawings for storage in liquid state. In a further modification, the main compressor 2 may include an additional stage or stages of compression downstream of the adsorption unit 4 thereby enabling the first booster-compressor 6 and/or the second booster-compressor 50 to be omitted. In a yet further modification a part of the liquid air stream downstream of the Joule-Thomson or throttling valve 56 may by-pass the higher pressure column 18, be subcooled by passage through the heat exchanger 28, and be united upstream of the valve 62 with the liquid stream from the outlet 60. Further, if desired, the by-passed liquid may form the entire stream of fluid passed to the valve 62.

In a typical example of operation of the plant shown in FIG. 1 of the drawings, the plant operates with parameters as shown in the Table below.

TABLE

| | |
|---|---|
| Outlet pressure of compressor 6 | 5.55 bar a |
| Flow through inlet 24 relative to total purified air flow | 48% |
| Outlet pressure of compressor 2 | 2.5 bar a |
| Flow through expansion turbine 40 relative to total purified air flow | 26% |
| Purity of oxygen product | 96 mole percent |
| Pressure of oxygen product at warm end 10 of main heat exchanger 8 | 5.0 bar |
| Flow of oxygen product relative to total purified air flow | 21% |

The power consumed in operating in this manner is in the order of 94% of a comparable plant in which all of the compressed, purified air flows to the further compressor 6 and the flow to the expansion turbine 40 is taken from the further compressed air. A greater heat exchange surface area in the main heat exchanger 8 of the plant shown in FIG. 1 will, however, be required.

The total power consumption of the plant may be reduced if an oxygen product purity of less than 96 mole per cent is required. In general, excessive refrigeration tends to be produced in the comparable plant when the oxygen purity is greater than 90 mole per cent.

I claim:

1. A method of separating air by rectification including cooling a first stream of compressed air taken from a first compression stage, at a first pressure, in a main heat exchanger to a temperature suitable for its separation by rectification, introducing the cooled first stream without further compression into the higher pressure column of a double rectification column including, in addition to the higher pressure column, a lower pressure column, in which a bottom liquid oxygen fraction is formed and a condenser-reboiler placing the higher pressure column in indirect heat exchange relationship with the lower pressure column, expanding in an expansion turbine from a second pressure with the performance of external work a second stream of compressed air taken from a second compression stage at the second pressure, introducing the expanded second stream of air into the lower pressure column, and taking an oxygen product from the bottom region of the lower pressure column, wherein the second pressure is less than the first pressure, the cooled first stream is introduced into the higher pressure column at essentially the first pressure, the first compression stage is downstream of the second compression stage, and the expansion turbine is the sole expansion turbine used in the method.

2. The method of claim 1 wherein the second stream of compressed air is raised to the second pressure in a main air compressor which has an outlet pressure lower than the operating pressure of the higher pressure column.

3. The method of claim 1 wherein the oxygen product is impure, having an oxygen content in the range of 50 to 98.5 mole per cent.

4. The method of claim 1 wherein a further oxygen product is withdrawn from an intermediate region of the lower pressure column, the oxygen content of the oxygen product withdrawn from the bottom of the bottom region of the lower pressure column is at least 97.5 mole per cent, and the oxygen content of the further product is in the range of 50 to 97 mole per cent.

5. The method of claim 4 wherein both oxygen products are withdrawn from the lower pressure column in liquid state, are pressurized, and are vaporized in indirect heat exchange with a third flow of the compressed air which is at a third pressure higher than the first pressure.

6. The method according to claim 1 wherein the impure oxygen product is withdrawn from the lower pressure column in liquid state, is pressurized, and is vaporized in indirect heat exchange with a third flow of the compressed air which is at a third pressure higher than the first pressure.

7. The method of claim 1 wherein 23 to 30 percent by volume of the air to be separated forms the expanded second air stream.

8. The method of claim 1 wherein the oxygen product withdrawn from the bottom of the lower pressure column is take in vapor state.

9. The method of claim 1 wherein the expansion turbine has a ratio of inlet pressure to outlet pressure in the range of 1.4:1 to 2.5:1.

10. A plant for separating air by rectification comprising at least two compression stages in series for compressing a flow of air, a main heat exchanger having at least one first passage for the cooling at a first pressure of a first stream of the compressed air to a temperature suitable for its rectification, the at least one first passage communicating with a first chosen one of the compression stages, whereby the first pressure is essentially the outlet pressure of the first chosen compression stage, and at least one second passage for the cooling at a second pressure of a second stream of the compressed air to a temperature above that suitable for its rectification, the at least one second passage communicating with a second chosen one of the compression stages whereby the second pressure is essentially the outlet pressure of the second chosen compression stage, a double rectification column including a higher pressure column, a lower pressure column, and a condenser-reboiler placing the higher pressure column in indirect heat exchange relationship with the lower pressure column, the higher pressure column being arranged to operate under a pressure at its bottom not greater than the first pressure, and the lower pressure column being arranged to operate so as to produce therein an bottom liquid oxygen fraction; an inlet to the higher pressure column communicating with the at least one first passage; an expansion turbine for expanding with the performance of external work the second stream of the compressed air, the expansion turbine being arranged to operate at an inlet pressure not greater than the second pressure; an inlet to the lower pressure column communicating with the expansion turbine, and an outlet from a bottom region of the lower pressure column for an oxygen product, wherein the first chosen compression stage is downstream of the second chosen compression stage, whereby the second pressure is less than the first pressure, there is no expansion means intermediate the at least one first passage and the higher pressure column, and the expansion turbine is the sole expansion turbine in the plant.

11. The plant according to claim 10 further comprising a pump for withdrawing the oxygen product in liquid state and raising it in pressure, and means for vaporising the pressurized oxygen product.

12. The plant according to claim 11 wherein the means for vaporising the pressurized oxygen product is either the main heat exchanger or a vaporising heat exchanger separate from the main heat exchanger; and the heat exchanger in which the oxygen product is vaporized has passage therethrough for a third compressed air stream at a third pressure greater than the first pressure.

13. A plant for separating air by rectification comprising at least two compression stages in series for compressing a flow of air, a main heat exchanger having at least one first passage for the cooling at a first pressure of a first stream of the compressed air to a temperature suitable for its rectification, the at least one first passage communicating with a first chosen one of the compression stages, whereby the first pressure is essentially the outlet pressure of the first chosen compression stage, and at least one second passage for the cooling at a second pressure of a second stream of the compressed air to a temperature above that suitable for its rectification, the at least one second passage communicating with a second chosen one of the compression stages whereby the second pressure is essentially the outlet pressure of the second chosen compression stage, a double rectification column including a higher pressure column, a lower pressure column, and a condenser-reboiler placing the higher pressure column in indirect heat exchange relationship with the lower pressure column, the higher pressure column being arranged to operate under a pressure at its bottom not greater than the first pressure, and the lower pressure column being arranged to operate so as to produce therein an bottom liquid oxygen fraction; an inlet to the higher pressure column communicating with the at least one first passage; an expansion turbine for expanding with the performance of external work the second stream of the compressed air, the expansion turbine being arranged to operate at an inlet pressure not greater than the second pressure; an inlet to the lower pressure column communicating with the expansion turbine, and an outlet from the lower pressure column for withdrawing an oxygen product in vapor state, wherein the first chosen compression stage is downstream of the second chosen compression stage, whereby the second pressure is less than the first pressure, there is no expansion means intermediate the at least one first passage and the higher pressure column, and the expansion turbine is the sole expansion turbine in the plant.

* * * * *